US010301759B2

(12) United States Patent
Kim et al.

(10) Patent No.: US 10,301,759 B2
(45) Date of Patent: May 28, 2019

(54) BALANCER AND WASHING MACHINE HAVING THE SAME

(71) Applicant: SAMSUNG ELECTRONICS CO., LTD., Suwon-si, Gyeonggi-do (KR)

(72) Inventors: Young Hyun Kim, Suwon-si (KR); Sang Up Lee, Yongin-si (KR); Dae Gyu Kang, Suwon-si (KR); Seung Youp Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1068 days.

(21) Appl. No.: 14/518,426

(22) Filed: Oct. 20, 2014

(65) Prior Publication Data

US 2015/0121968 A1 May 7, 2015

(30) Foreign Application Priority Data

Nov. 5, 2013 (KR) ..... 10-2013-0133731

(51) Int. Cl.
*D06F 37/24* (2006.01)

(52) U.S. Cl.
CPC ..... *D06F 37/24* (2013.01)

(58) Field of Classification Search
None
See application file for complete search history.

(56) References Cited

U.S. PATENT DOCUMENTS

2004/0172987 A1* 9/2004 Lim ..... D06F 37/245 68/23.1
2006/0254321 A1* 11/2006 Lim ..... D06F 37/225 68/12.01

FOREIGN PATENT DOCUMENTS

| | | | | |
|---|---|---|---|---|
| CN | 101994230 | A | | 3/2011 |
| CN | 102041658 | A | | 5/2011 |
| CN | 102362027 | A | | 2/2012 |
| CN | 102443999 | A | | 5/2012 |
| CN | 103194873 | A | | 7/2013 |
| EP | 2432926 | | | 11/2010 |
| JP | 07039679 | A | * | 2/1995 |
| WO | WO2008/012076 | A1 | * | 1/2008 |
| WO | 2010/133480 | A1 | | 11/2010 |

OTHER PUBLICATIONS

Chinese Office Action dated Oct. 10, 2017 in corresponding Chinese Patent Application No. 201410638143.5.
Chinese Patent Office issued the Decision on Grant in Chinese Patent Application No. 201410638143.5 dated Jul. 5, 2018 (Total pages of 4).

* cited by examiner

*Primary Examiner* — David G Cormier
*Assistant Examiner* — Jason P Riggleman
(74) *Attorney, Agent, or Firm* — Staas & Halsey LLP

(57) ABSTRACT

A washing machine includes a cabinet, a tub provided inside the cabinet to store wash water therein, a drum rotatably provided inside the tub, and a balancer comprising an upper side surface covering an outer surface of a bottom of the drum and a lower side surface formed at one side of the upper side surface in a planar shape while facing an inner surface of a bottom of the tub. The balancer is configured to counterbalance an unbalanced load of the drum, thereby saving energy and enhancing balancing efficiency.

15 Claims, 8 Drawing Sheets

BALANCER AND WASHING MACHINE HAVING THE SAME

CROSS-REFERENCE TO RELATED APPLICATIONS

This application claims the benefit of Korean Patent Application No. 10-2013-0133731, filed on Nov. 5, 2013, in the Korean Intellectual Property Office, the disclosure of which is incorporated herein by reference.

BACKGROUND

1. Field

Embodiments of the present disclosure relate to a balancer for reducing energy consumption, and a washing machine having the same.

2. Description of the Related Art

A washing machine is an appliance that washes laundry using electric power. In general, a washing machine includes a cabinet forming an external appearance of the washing machine, a tub to store wash water in the cabinet, a drum rotatably installed in the tub, and a motor configured to rotatably drive the drum.

When the drum is rotated by the motor in a state that laundry and detergent water are put into the drum, laundry is in friction with the drum and the detergent water so that dirt can be removed from the laundry.

If laundry is not equally distributed but accumulates at one side of the drum when the drum rotates, vibration and noise may occur due to eccentric rotation of the drum, and components such as the drum, the motor or the like may be damaged.

Accordingly, the washing machine is equipped with a balancer in order to stabilize rotation of the drum by counterbalancing an unbalanced load generated in the drum.

SUMMARY

Therefore, it is an aspect of the present disclosure to provide a balancer having an improved balancing performance, and a washing machine having the same. It is another aspect of the present disclosure to provide a balancer capable of reducing friction with wash water, and a washing machine having the same.

Additional aspects of the disclosure will be set forth in part in the description which follows and, in part, will be apparent from the description, or may be learned by practice of the disclosure.

In accordance with one aspect of the present disclosure, a washing machine includes a cabinet, a tub, a drum and a balancer. The tub may be provided inside the cabinet to store wash water therein. The drum may be rotatably provided inside the tub. The balancer may include an upper side surface covering an outer surface of a bottom of the drum and a lower side surface formed at the opposite side of the upper side surface in a planar shape while facing an inner surface of a bottom of the tub, the balancer configured to counterbalance an unbalanced load of the drum.

The balancer includes a balancer housing mounted at the outer surface of the bottom of the drum, and a channel provided inside the balancer housing and allowing a plurality of mass bodies to be moved therein. The channel may include a plurality of channels concentrically disposed.

The channel may include a plurality of inner channels each having an arc shape and spaced apart from each other in a circumferential direction, and an outer channel having a ring shape and disposed at an outer side of the inner channels.

The washing machine may further include a flange shaft having support blades formed in a radial direction to support a lower portion of the drum, and provided on a rotary shaft of the drum to selectively rotate the drum. The balancer may include a balancer housing mounted at an outer surface of a bottom of the drum, and insertion grooves formed from a center of the balancer housing in a radial direction and allowing the support blades to be inserted thereinto.

The balancer may further include a channel including a plurality of inner channels each having an arc shape and spaced apart from each other in a circumferential direction, and an outer channel having a ring shape and disposed at an outer side of the inner channels, the channel provided inside the balancer housing and allowing a plurality of mass bodies to be moved therein. The plurality of inner channels may be divided by the insertion grooves.

The insertion groove may include a pair of insertion lateral sides forming a depth of the insertion groove, and a gap may be formed between the insertion lateral side and the support blade to prevent lint included in the wash water from being accumulated.

A water storage space storing the wash water may be provided between the drum and the tub. The balancer may be disposed in the water storage space.

The balancer may be provided so as to be detachable from the drum.

In accordance with another aspect of the present disclosure, a washing machine includes a cabinet, a tub, a drum, a flange and a balancer. The tub may be provided inside the cabinet to store wash water therein. The drum may be rotatably provided inside the tub. The flange shaft may have support blades formed in a radial direction to support a lower portion of the drum, and may be provided on a rotary shaft of the drum to selectively rotate the drum. The balancer may have insertion grooves covered by the support blades inserted thereinto, and configured to cover at least one portion of the drum to counterbalance an unbalanced load of the drum.

The balancer may include an outer circumference part corresponding to a circumference of a bottom of the drum, and an inner circumference part spaced apart from the rotary shaft by a predetermined interval at an inner side of the outer circumference part. The balancer may be formed between the outer circumference part and the inner circumference part.

The balancer may include a balancer housing mounted at an outer surface of a bottom of the drum, and a plurality of channels provided inside the balancer housing and allowing a plurality of movable mass bodies to be moved therein. The plurality of channels may be concentrically disposed.

The channel may include a plurality of inner channels spaced apart from each other by a predetermined interval in a circumferential direction, and an outer channel having a ring shape and disposed at an outer side of the inner channel.

A water storage space of the tub in which wash water is stored may include a first water storage space and a second water storage space. The first water storage space may be provided in the drum and storing wash water that performs a wash operation. The second water storage space may be provided between the drum and the tub and storing wash water that does not perform a wash operation. The balancer may be disposed in the second water storage space at the outer surface of the bottom of the drum.

The insertion groove may have a first depth corresponding to a thickness of the support blade such that the support blade is inserted into the insertion groove.

The balancer may include an upper side surface in which the insertion groove is formed; and a lower side surface formed at the opposite side of the upper side surface in a planar shape while facing an inner surface of a bottom of the tub.

As is apparent from the above, the balancer and the washing machine having the same can provide an improved balancer structure, thereby improving the balancing performance and reducing friction with wash water, and thus minimizing bubbles generated in the tub.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
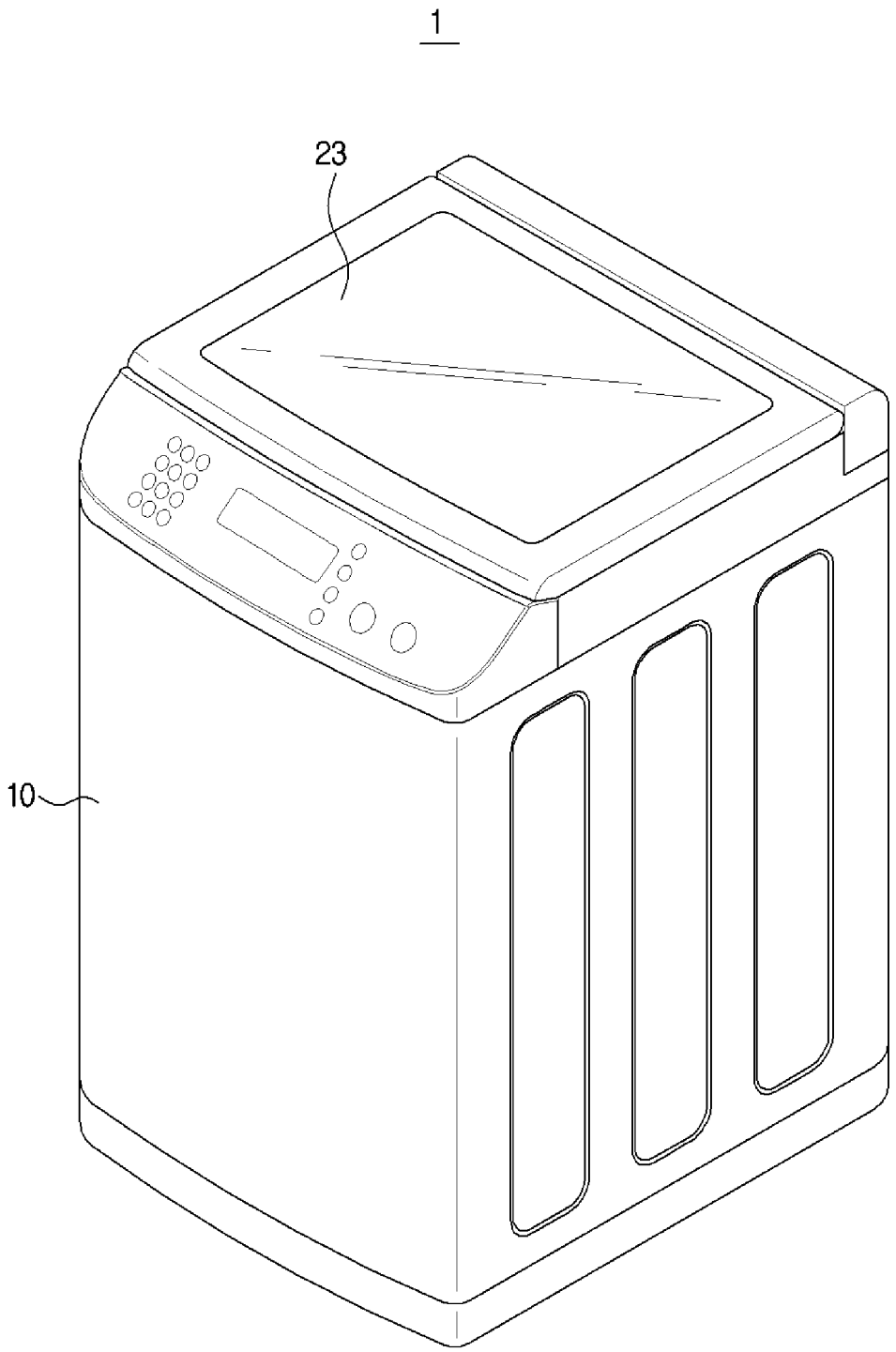
FIG. 1 is a perspective view illustrating a washing machine in accordance with an embodiment of the present disclosure.

Reference will now be made in detail to the embodiments of the present disclosure, examples of which are illustrated in the accompanying drawings, wherein like reference numerals refer to like elements throughout.

Figure 2:
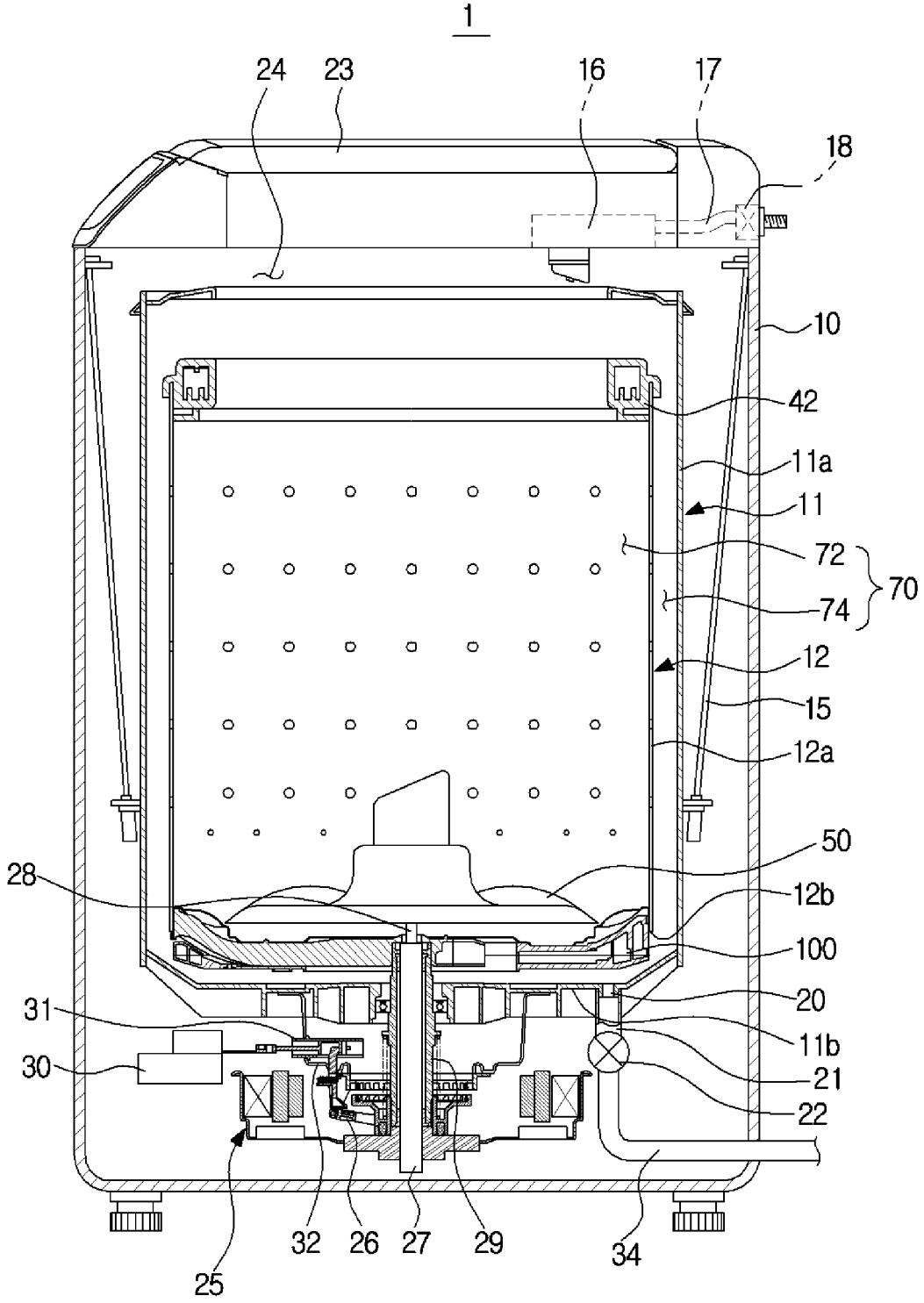
FIG. 2 is a cross-sectional view illustrating a washing machine in accordance with an embodiment of the present disclosure.

FIG. 1 is a perspective view illustrating a washing machine in accordance with an embodiment of the present disclosure, and FIG. 2 is a cross-sectional view illustrating a washing machine in accordance with an embodiment of the present disclosure.

Referring to FIGS. 1 and 2, a washing machine 1 includes a cabinet 10 forming the external appearance of the washing machine 1, a tub 11 disposed inside the cabinet 10 to store wash water, a drum 12 rotatably disposed in the tub 11 and a pulsator 50 disposed inside the drum 12 to generate water current.

An input port 24 allowing laundry to be put into the drum 12 therethrough is formed at an upper portion of the cabinet 10. The input port 24 may be open and closed by a door 23 installed at an upper portion of the cabinet 10. The tub 11 is supported by the cabinet 10 by a suspension apparatus 15.

A water supply pipe 17 configured to supply wash water to the tub 11 is provided at an upper side of the tub 11. One side of the water supply pipe 17 is connected to an external water source, and the other side of the water supply pipe 17 is connected to a detergent supply device 16. Water supplied through the water supply pipe 17 is supplied to the tub 11 together with detergent via the detergent supply device 16. A water supply valve 18 is installed at the water supply pipe 17 to control the supply of water. The tub 11 may include a cylindrical part 11*a* and a bottom part 11*b*.

The drum 12 is provided in the shape of a cylinder having an upper portion thereof open, and a plurality of dehydration holes 13 are formed at a side surface of the cylindrical part 12. In detail, the drum 12 may include a cylindrical part 12*a* and a bottom part 12*b*, and the dehydration holes 13 are formed through the cylindrical part 12*a*. Balancers 42 and 100 may be mounted at an upper portion of the drum 12 such that the drum 12 stably rotates at a high speed.

The balancers 42 and 100 include an upper balancer 42 and a lower balancer 100, and a balancer in accordance with an exemplary embodiment of the present disclosure represents the lower balancer 100 provided at a lower side of the tub. Hereafter, the lower balancer 100 will be referred to as the balancer 100 for convenience sake of description.

A motor 25 generating a driving force to rotate the drum 12 and a pulsator 50, and a power switching device 26 configured to simultaneously or selectively transferring driving force generated from the motor 25 to the drum 12 and the pulsator 50 are provided at an outside of a lower portion of the tub 11.

A flange shaft is coupled to the tub 11 and the drum 12.

The flange shaft is provided on a rotary shaft of the drum 12 and the pulsator 50 to selectively rotate the drum 12 and the pulsator 50. The configuration of the flange shaft is not limited, and in accordance with an exemplary embodiment of the present disclosure, the flange shaft includes a wash shaft 27, a spinning shaft 29 and a wash shaft coupling part 28.

The spinning shaft 29 in a hollow type is coupled to the bottom part 12*b* of the drum 12, and the wash shaft 27 installed at a hollowness part of the spinning shaft 29 is coupled to the pulsator 50 through the wash shaft coupling part 28. The motor 25 may simultaneously or selectively transfer a driving force to the drum 12 and the pulsator 50 according to up and down motion of the power switching device 26.

The power switching device 26 includes an actuator 30 generating a driving force for power switching, a rod part 31 linearly moving according to operation of the actuator 30, and a clutch part 32 connected to the rod part 31 to rotate according to operation of the rod part 31.

A drainage port 20 is provided at the bottom of the tub 11 to discharge wash water stored in the tub 12, and a first drain pipe 21 is connected to the drainage port 20. A drain valve 22 may be installed at the first drain pipe 21 to control drainage. An outlet of the drain valve 22 is connected to a second drain pipe 34 to discharge wash water to the outside.

Figure 3:
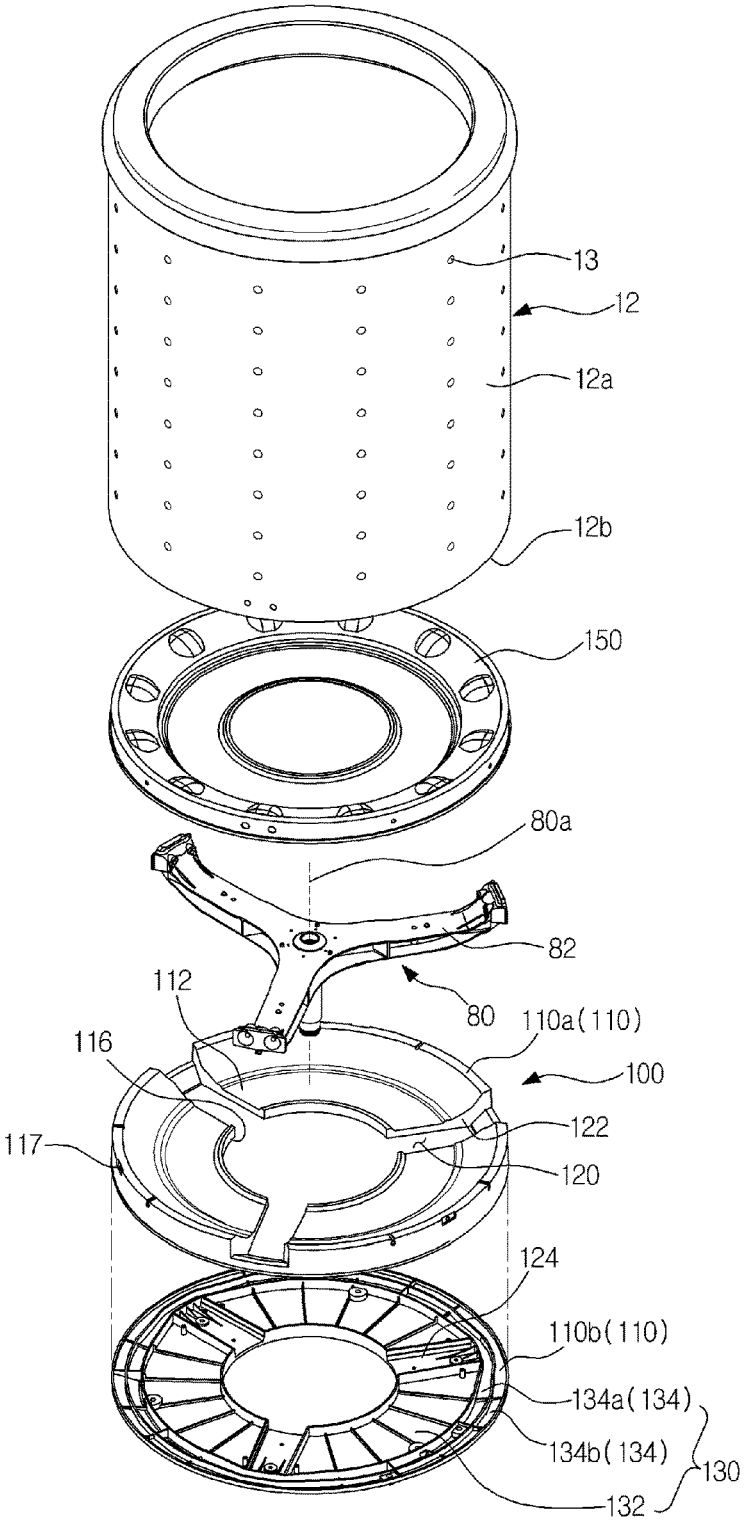
FIG. 3 is an exploded perspective view illustrating a washing machine in accordance with an embodiment of the present disclosure.

FIG. 3 is an exploded perspective view illustrating a washing machine in accordance with an embodiment of the present disclosure.

As described above, the drum 12 is rotatably provided in the tub 11. The drum 12 is rotated by receiving a driving force through the flange shaft 80.

The flange shaft 80 is connected to the motor 25, and in a state of being coupled to the tub 11, selectively rotate the pulsator 50 and the drum 12.

The flange shaft 80 may include support blades 82.

The support blades 82 support a lower portion of the drum 12, that is, the bottom part 12*b*, when the drum 12 is rotated by the flange shaft 80, such that the drum 12 is stably rotated.

The number of support blades 82 is not limited, and configured to support the lower portion of the drum 12 while being spaced apart from each other. In accordance with an exemplary embodiment of the present disclosure, a total of the three support blades 82 are provided while being spaced apart from each other by an angle of about 120 degrees.

Since the support blades 82 support the lower portion of the drum 12, that is, the bottom 12*b*, the support blades 82 are provided to protrude beyond an outer surface of the bottom part 12*b* of the drum 12.

The balancer 100 is provided to counterbalance the unbalanced load generated in the drum 12 during rotation of the drum 12. The balancer 100 is provided to cover at least one portion of the lower portion of the drum 12 at the outside of the bottom part 12*b*. In addition, the balancer 100 is provided so as to be detachable from the drum 12 and the flange shaft 80.

Hereinafter, the balancer 100 will be described in detail.

Figure 4:
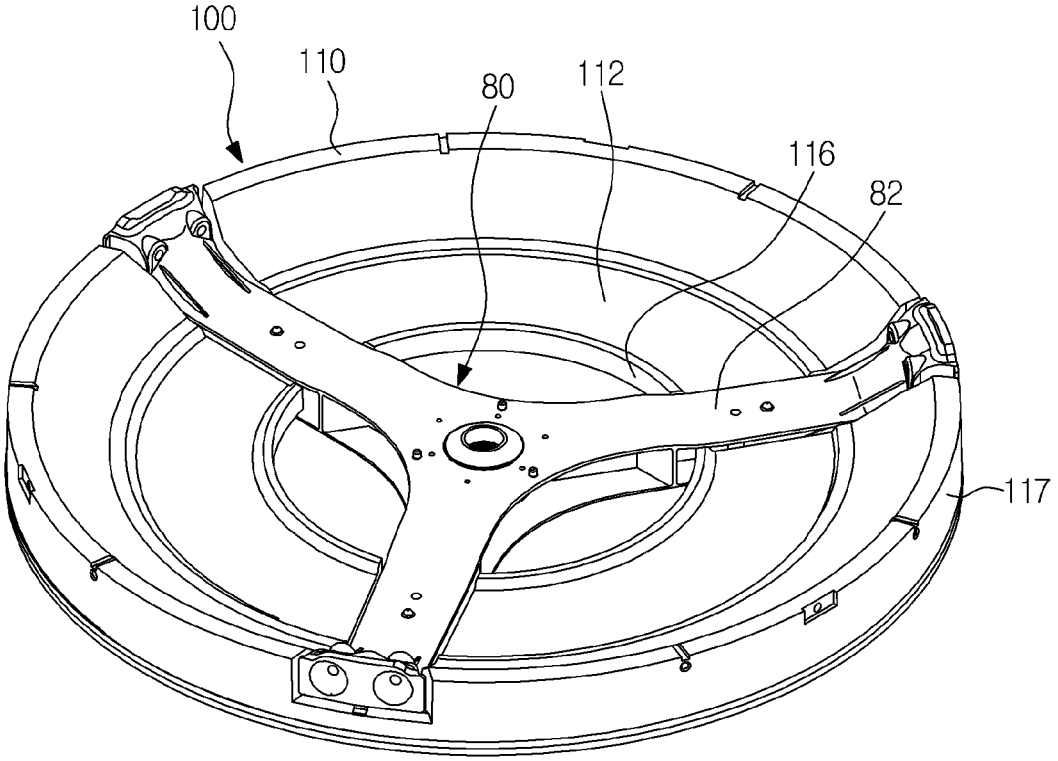
FIG. 4 is a perspective view illustrating a balancer in accordance with an embodiment of the present disclosure.
Figure 5:
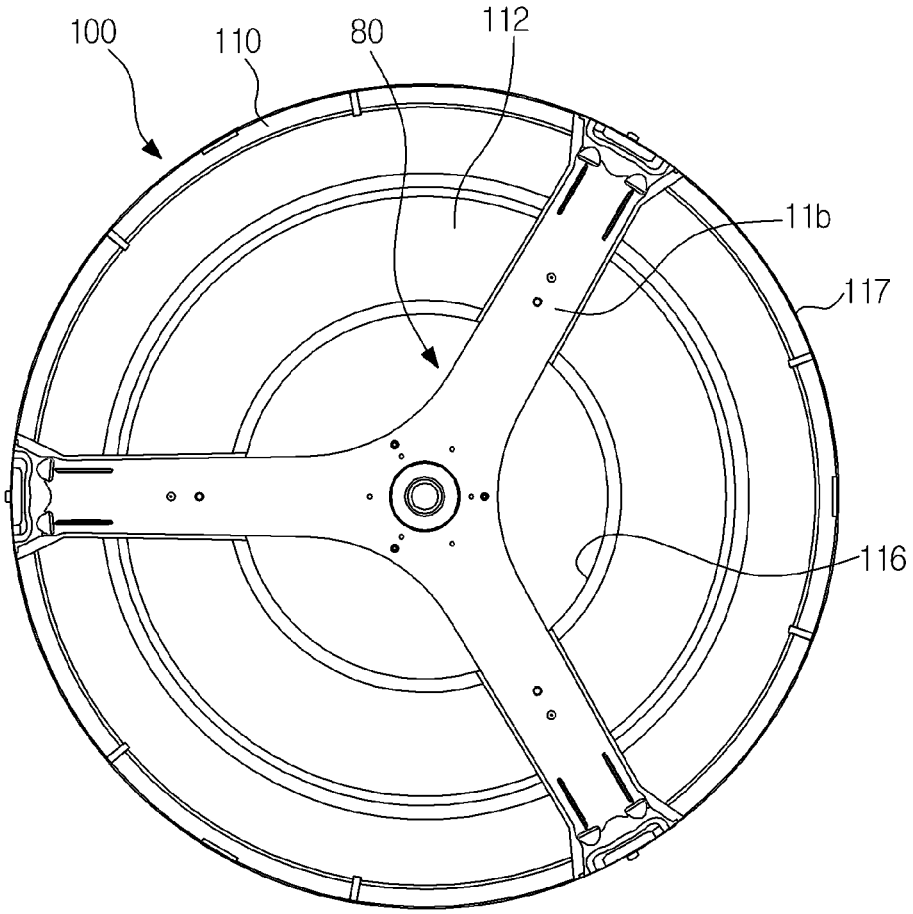
FIG. 5 is a top view of a balancer in accordance with an embodiment of the present disclosure.
Figure 6:
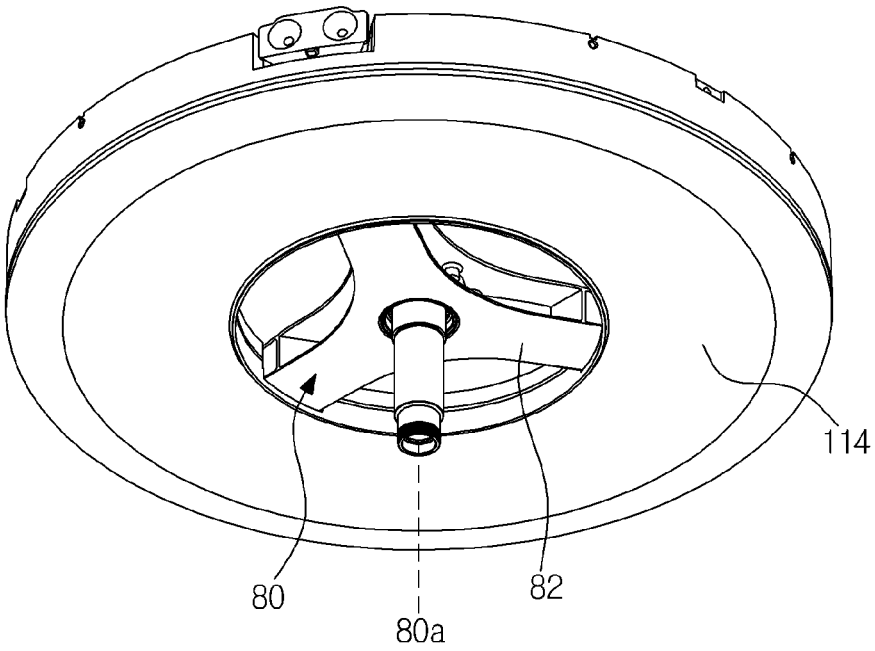
FIG. 6 is a bottom perspective view of a balancer in accordance with an embodiment of the present disclosure.
Figure 7:
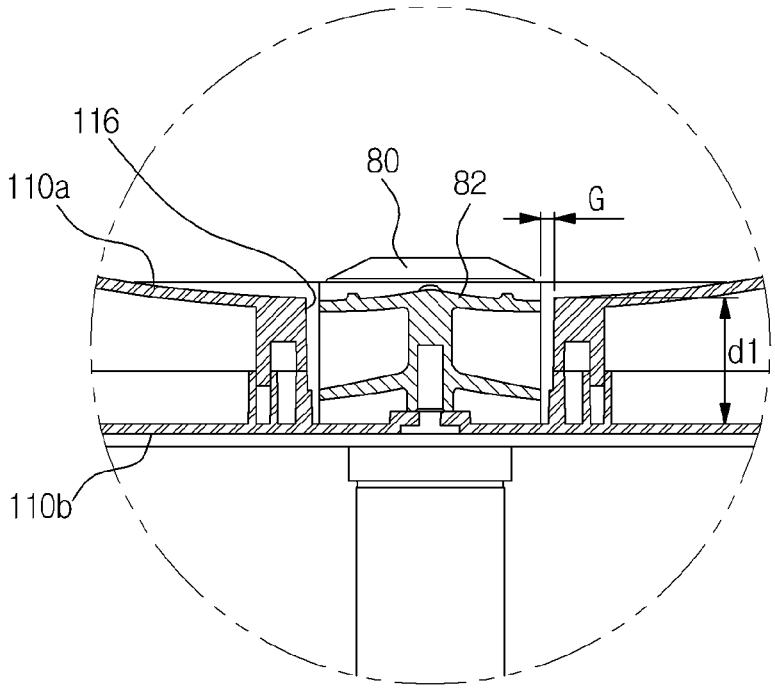
FIG. 7 is a cross sectional view taken along line A-A' of FIG. 4.

FIG. 4 is a perspective view illustrating a balancer in accordance with an embodiment of the present disclosure, FIG. 5 is a top view of a balancer in accordance with an embodiment of the present disclosure, FIG. 6 is a bottom perspective view of a balancer in accordance with an embodiment of the present disclosure, and FIG. 7 is a cross sectional view taken along line A-A' of FIG. 4.

The balancer 100 includes a balancer housing 110 and a channel 130 provided in the balancer housing 110.

The balancer housing 110 forms the external appearance of the balancer 100. The balancer housing 110 is provided to cover at least one portion of the bottom part 12*b* of the drum 12. The balancer housing 110 is provided between an inner circumference part 116 spaced apart from a rotary shaft 80*a* of the flange shaft 80 and an outer circumference part 117 corresponding to a circumference of the bottom part 12*b* of the drum 12. The inner circumference part 116 is spaced apart from the rotary shaft 80*a* of the flange shaft 80 to prevent the balancer housing 110 from being interfered due to a rotating force of the flange shaft 80.

Different from the upper balancer 42 provided at an upper side of the drum 12, the balancer 100 is provided at a lower side of the drum 12, so that the balancer 100 has a wide space for balancing without being affected by the input port 24, thereby improving the balancing effects.

The balancer housing 110 includes an upper housing 110 and a lower housing 110*b*. The upper housing 110*a* includes an upper side surface 112, which is to be described later, and insertion lateral sides 122, and the lower housing 110*b* includes a lower side surface 114, which is to be described later. In addition, the channel 130 is formed in a space formed as the upper housing 110*a* is coupled to the lower housing 110*b*.

The balancer housing 110 includes the upper side surface 112 and the lower side surface 114.

The upper side surface 112 is configured to cover the bottom part 12*b* of the drum 12. In detail, the upper side surface 112 is provided to cover at least one portion of an outer surface of the bottom part 12*b* of the drum 12, and to this end, the upper side surface 112 is provided to have a shape corresponding to the shape of the outer surface of the bottom part 12*b* of the drum 12.

The lower side surface 114 is formed from the opposite side of the upper side surface 112 in a planar shape while facing an inner surface of the bottom part 11*b* of the tub 11. That is, the lower side surface 114 is provided with a planar surface so as to reduce friction resistance with wash water in a state of being disposed at a lower side of the upper side surface 112 when the drum 12 rotates.

Wash water is stored in the tub 11, and when the drum 12 is rotated at the inside of the tub 11, friction resistance with wash water is generated due to a lower structure of the drum 12, bubbles are generated from wash water. The lower side surface 114 of the balancer 100 is provided in a flat shape to minimize friction resistance with wash water and prevent the bubbles from being generated. In addition, the lower side surface 114 may have a curved surface as long as it is provided as a smooth surface.

According to rotation of drum 12, bubbles are generated from wash water due to friction resistance between the drum 12 and the tub 11. In this case, the energy consumption required to rotate the drum 12 is increased, which degrades the energy saving efficiency.

Accordingly, in accordance with an exemplary embodiment of the present disclosure, by fixing the balancer 100 having the lower side surface 114, which is flat, to the bottom part of the drum 12, friction resistance with wash water is reduced at rotation of the drum 12, thereby enhancing the energy saving efficiency.

The balancer housing 110 may be fixedly disposed at the bottom part of the drum 12. In detail, a cylindrical fixing part 150 is provided to surround the balancer 100, so that the drum 12 is screwed to a side surface of the balancer 100. The cylindrical fixing part 150 is provided to surround a circumference of the balancer housing 110 and a lower circumference of the drum 12 to couple the drum 12 to the balancer 100. However, the configuration of the cylindrical fixing part 150 is not limited thereto as long as it can couple the balancer housing 110 to the lower portion of the drum 12. Alternatively, the cylindrical fixing part 150 may be omitted, and the balancer housing 110 may be directly coupled to the drum 12.

The balancer 100 may further include insertion grooves 120 into which the support blades 82 are inserted.

The insertion groove 120 is a part on which the support blades 82 of the flange shaft 80 are mounted, and may be provided at the upper side surface 112. Although the insertion grooves 120 are provided to correspond to the width and thickness of the support blades 82, the number and depth of the insertion grooves 120 are not limited. In accordance with an exemplary embodiment of the present disclosure, a total of the three support blades 82 are provided are provided while being spaced apart from each other by an angle of 120 degrees.

The insertion groove 120 may include the insertion lateral side 122 forming the depth of the insertion groove 120 and an insertion bottom 124 forming the bottom of the insertion groove 120. The insertion lateral sides 122 are provided in one pair, and has a size equal to or larger than the width of the support blade 82. In detail, the insertion lateral sides 122 may be provided while being spaced apart from the support blade 82 by a predetermined interval G to prevent lint contained in wash water from being accumulated between the insertion groove 120 and the support blade 82 inserted into the insertion groove 120.

The insertion bottom 124 forming the bottom of the insertion groove 120 is coupled to the support blade 82, thereby allowing the balancer housing 110 to be coupled to the support blades 82. The coupling scheme of the balancer housing 110 and the support blade 82 is not limited, and in accordance with an exemplary embodiment of the present disclosure, the balancer housing 110 is coupled to the support blade 82 through a screw scheme.

The insertion groove 120 is provided in a first depth d1 corresponding to the thickness of the support blade 82, enabling the support blade 82 to be inserted into the insertion groove 120. That is, the first depth d1 has a thickness equal to a length of the first depth d1 such that the support blade 82 is inserted into the insertion groove 120, or may have a thickness larger than a length of the first depth d1 to enhance flow of wash water between the balancer 100 and the drum 12.

In addition, the balancer housing 110 needs to cover the support blade 82 while including the insertion groove 120 having the first depth d1. Accordingly, the balancer housing 110 is provided in a thickness of a second thickness larger than the first thickness.

Figure 8:
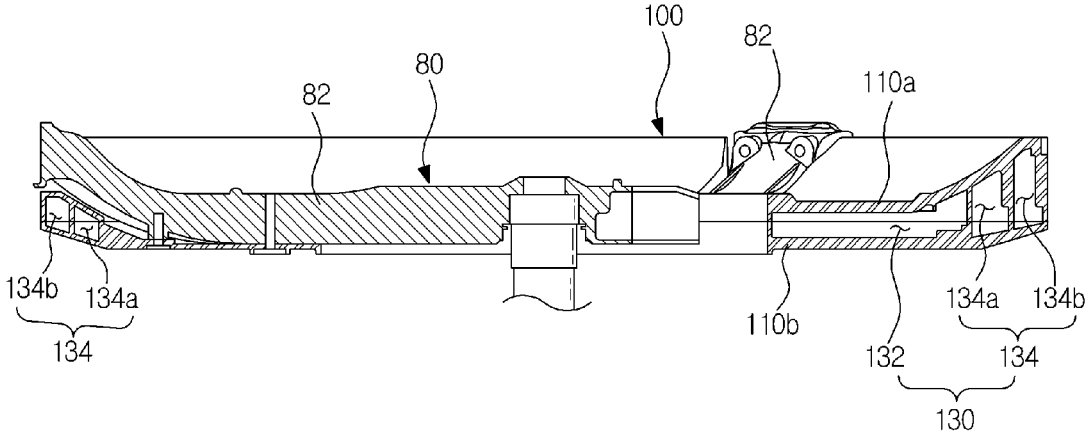
FIG. 8 is a cross sectional view taken along line B-B' of FIG. 4.

FIG. 8 is a cross sectional view taken along line B-B' of FIG. 4.

The balancer 100 may include the channel 130 provided in the balancing housing.

The channel 130 is formed in the balancing housing such that mass bodies are moved along the channel 130. The channel 130 may include a plurality of channels provided in parallel to each other while being concentrically disposed. The mass bodies include a spherical body or fluid that may flow, but the present disclosure is not limited thereto as long as it can flow in the channel 130.

The channel 130 may include inner channels 132 and an outer channel 134.

The inner channels 132 each have an arc shape and spaced apart from each other in a circumferential direction. The outer channel 134 may have a ring shape and disposed at an outer side of the inner channels 132.

In detail, the inner channels 132 are divided by the insertion grooves 120 on the balancer 100, and the inner channels 132 divided are provided to be spaced apart from each other in a circumferential direction by an interval corresponding to the width of the insertion groove 120. The outer channel 134 is formed along the circumference of the balancer 100 without being affected by the insertion groove 120. The outer channel 134 may be also divided by the insertion grooves 120 together with the inner channel 132. However, in accordance with an exemplary embodiment of the present disclosure, the outer channel 134 is not divided but connected by a channel connecting part provided on the balancer 100.

In addition, each of the inner channel 132 and the outer channel 134 may be divided into a plurality of channels in a concentric form. In accordance with an exemplary embodiment of the present disclosure, the outer channel 134 is divided into a first outer channel 134*a* and a second outer channel 134*b* and each serves as an individual balancer 100.

Through the above configuration, various types of channels 130 may be provided at the same balancer 100, so that the unbalanced load generated in the drum 12 is effectively counterbalanced.

The following description will be made in relation to the effects of saving wash water depending on the disposition of the balancer 100.

Referring to FIG. 2, wash water is stored in the tub 11, and the drum 12 is rotatably provided in the tub 11. The tub 12 exchanges wash water with the drum 12 through the dehydration hole 13 provided at the drum 12.

In this case, the wash water used in the tub 11 is saved by disposing the balancer 100 in accordance with the present invention.

In other words, the balancer 100 may be disposed between the outer surface of the bottom part of the drum 12 and the inner surface of the bottom part of the tub 11. A water storage space 70 in which wash water stored in the tub 11 is stored includes a first water storage space 72 storing wash water that is introduced into the drum 12 and substantially performs a wash operation, and a second water storage space 74 provided between the tub 11 and the drum 12 and storing wash water that does not perform a wash operation. The balancer 100 in accordance with an exemplary embodiment of the present disclosure is disposed in the second water storage space 74, so that wash water that does not perform wash water is saved as much as the volume of the balancer 100.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub provided inside the cabinet to store wash water therein;

a drum rotatably provided inside the tub;

a flange shaft having support blades formed in a radial direction to support a lower portion of the drum, and provided on a rotary shaft of the drum to selectively rotate the drum; and a balancer comprising an upper side surface covering an outer surface of a bottom of the drum and a lower side surface formed at the opposite side of the upper side surface in a planar shape while facing an inner surface of a bottom of the tub, the balancer configured to counterbalance an unbalanced load of the drum, wherein the balancer comprises a balancer housing mounted at the outer surface of the bottom of the drum;

a channel provided inside the balancer housing; and a plurality of mass bodies movably disposed in the channel, wherein the channel comprises a plurality of inner channels each having an arc shape and spaced apart from each other by the support blades in a circumferential direction, and an outer channel having a ring shape and disposed at an outer side of the plurality of inner channels.

2. The washing machine of claim 1, wherein the balancer comprises a balancer housing mounted at an outer surface of a bottom of the drum; and insertion grooves formed from a center of the balancer housing in a radial direction and allowing the support blades to be inserted thereinto.

3. The washing machine of claim 2, wherein the plurality of inner channels are divided by the insertion grooves.

4. The washing machine of claim 2, wherein the insertion groove comprises a pair of insertion lateral sides forming a depth of the insertion groove, and a gap is formed between the insertion lateral side and the support blade to prevent lint included in the wash water from being accumulated.

5. The washing machine of claim 1, wherein a water storage space storing the wash water is provided between the drum and the tub, wherein the balancer is disposed in the water storage space.

6. The washing machine of claim 1, wherein the balancer is provided so as to be detachable from the drum.

7. A washing machine comprising:

a cabinet;

a tub provided inside the cabinet to store wash water therein;

a drum rotatably provided inside the tub;

a flange shaft having support blades formed in a radial direction to support a lower portion of the drum, and provided on a rotary shaft of the drum to selectively rotate the drum; and a balancer having insertion grooves covered by the support blades inserted thereinto, and configured to cover at least one portion of the drum to counterbalance an unbalanced load of the drum, and, wherein the balancer comprises:

a balancer housing mounted at an outer surface of a bottom of the drum;

a plurality of channels provided inside the balancer housing and disposed to be concentrically; and a plurality of movable mass bodies disposed in the plurality of channels, wherein the plurality of channels comprises:

a plurality of inner channels spaced apart from each other by the insertion groove in a circumferential direction; and an outer channel having a ring shape and disposed at an outer side of the plurality of inner channels.

8. The washing machine of claim 7, wherein the balancer further comprises:

an outer circumference part corresponding a circumference of a bottom of the drum; and an inner circumference part spaced apart from the rotary shaft by a predetermined interval at an inner side of the outer circumference part, wherein the balancer is formed between the outer circumference part and the inner circumference part.

9. The washing machine of claim 7, wherein a water storage space of the tub in which wash water is stored comprises:

a first water storage space provided in the drum and storing wash water that performs a wash operation;

a second water storage space provided between the drum and the tub and storing wash water that does not perform a wash operation, wherein the balancer is disposed in the second water storage space at the outer surface of the bottom of the drum.

10. The washing machine of claim 7, wherein each of the insertion grooves has a first depth corresponding to a thickness of the support blade such that the support blades are inserted into the insertion grooves.

11. A washing machine comprising:

a cabinet;

a tub provided inside the cabinet to store wash water therein;

a drum rotatably provided inside the tub;

a flange shaft having support blades formed in a radial direction to support a lower portion of the drum, and provided on a rotary shaft of the drum to selectively rotate the drum; and a balancer having insertion grooves covered by the support blades inserted thereinto, and configured to cover at least one portion of the drum to counterbalance an unbalanced load of the drum, wherein the balancer comprises:

a balancer housing having an upper side surface in which the insertion grooves are formed and a lower side surface formed at the opposite side of the upper side surface in a planar shape while facing an inner surface of a bottom of the tub; and, a plurality of inner channels formed in the balancer housing and spaced apart from each other by the insertion groove in a circumferential direction; and an outer channel formed in the balancer housing, the outer channel having a ring shape and disposed at an outer side of the plurality of inner channels.

12. A washing machine comprising:

a cabinet;

a tub provided inside the cabinet;

a drum rotatably provided inside the tub;

a flange shaft having support blades formed in a radial direction to support a lower portion of the drum, and provided on a rotary shaft of the drum to selectively rotate the drum;

a water storage space provided between the tub and the drum; and a balancer formed below the drum in the water storage space, the balancer being configured to counterbalance an unbalanced load of the drum, wherein the balancer comprises:

a balancer housing provided with a plurality of channels concentrically disposed in the balancer housing; and insertion grooves formed from a center of the balancer housing in a radial direction, the support blades being inserted into the insertion grooves, and wherein the plurality of channels includes:

a plurality of inner channels each having an arc shape and spaced apart from each other by the insertion grooves in a circumferential direction; and an outer channel having a ring shape and disposed at an outer side of the plurality of inner channels.

13. The washing machine of claim 12, further comprising a cylindrical fixing part configured to surround a circumference of the balancer and a lower circumference of the drum to couple the drum to the balancer.

14. The washing machine of claim 12, wherein the balancer is directly coupled to a lower surface of the drum.

15. The washing machine of claim 12, wherein a lower side surface of the balancer is provided in a flat shape to lower friction resistance with water in the water storage space and to prevent the bubbles from being generated in the water storage space.

* * * * *